US006264032B1

(12) United States Patent
Hobbs

(10) Patent No.: US 6,264,032 B1
(45) Date of Patent: Jul. 24, 2001

(54) MEMORIAL FAMILY FINDER AND METHOD OF USE

(76) Inventor: Scott C. Hobbs, 2211 Pacific Ave. #A-202, Costa Mesa, CA (US) 92627

( * ) Notice: Subject to any disclaimer, the term of this patent is extended or adjusted under 35 U.S.C. 154(b) by 0 days.

(21) Appl. No.: 09/466,860

(22) Filed: Dec. 17, 1999

(51) Int. Cl.[7] ..... B65D 85/00; E04H 13/00

(52) U.S. Cl. ..... 206/449; 40/124.5; 52/104; 52/105; 220/476

(58) Field of Search ..... 52/105, 103, 104; 40/124.5; 206/449; 211/50; 220/476; 248/205.3

(56) References Cited

U.S. PATENT DOCUMENTS 4,534,125 * 8/1985 Buck ..... 40/645
5,517,791 * 5/1996 Weiss ..... 52/105
5,732,515 * 3/1998 Rodrigues et al. ..... 52/103
5,787,625 * 8/1998 Yesbick ..... 40/718
6,105,288 * 8/2000 Becker ..... 40/124.5

* cited by examiner

*Primary Examiner*—Jim Foster
(74) *Attorney, Agent, or Firm*—Eric Karich

(57) ABSTRACT

A memorial family finder has a container having an opening shaped to receive a message having contact information. The container is positioned in proximity to a headstone of an ancestor, thereby allowing the message to be left in proximity to the headstone of an ancestor. The memorial family finder enables a method of finding distant relatives by leaving the message in proximity to the headstone of the ancestor. Distant relatives who visit the headstone of the common ancestor can then retrieve the message and contact the user as directed by the contact information.

4 Claims, 1 Drawing Sheet

MEMORIAL FAMILY FINDER AND METHOD OF USE

BACKGROUND OF THE INVENTION

1. Field of the Invention

This invention relates generally to methods of contacting distant relatives, and more particularly to a memorial family finder that enables a novel method of transmitting contact information to distant relatives who visit a grave site of a common ancestor.

2. Description of Related Art

There are many methods that can be used to track down distant relatives. These methods usually involve hiring professionals to search through governmental records to recreate family trees. However, there are many problems with using this process. First, it can be expensive and time consuming to pay someone to do the extensive research that is often required. Second, governmental records are often incomplete. Third, it is very difficult to track down some distant relatives if they have moved or changed their name.

The prior art teaches the method of searching government records to track down distant relatives. However, the prior art does not teach the use of a grave site of a common ancestor as a mechanism for sending messages to distant relatives who visit the grave site. The present invention fulfills these needs and provides further related advantages as described in the following summary.

SUMMARY OF THE INVENTION

The present invention teaches certain benefits in construction and use which give rise to the objectives described below.

The present invention provides a memorial family finder for attachment to a headstone and a method of attaching the memorial family finder to a headstone of an ancestor to locate distant relatives. The memorial family finder includes a container having an opening shaped to receive at least one information card. In use, a user leaves a message having his or her contact information in a container located in proximity to the headstone of the headstone. Distant relatives who visit the headstone of the common ancestor can then retrieve the at least one information card and contact the user.

A primary objective of the present invention is to provide a memorial family finder and method of use having advantages not taught by the prior art.

Another objective is to provide a memorial family finder that allows a user to establish contact with distant relatives through their common association with a headstone of a common ancestor.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a memorial family finder 10 and a method for finding distant relatives by leaving a message 40 in proximity to a headstone 12 of an ancestor.

Figure 1:
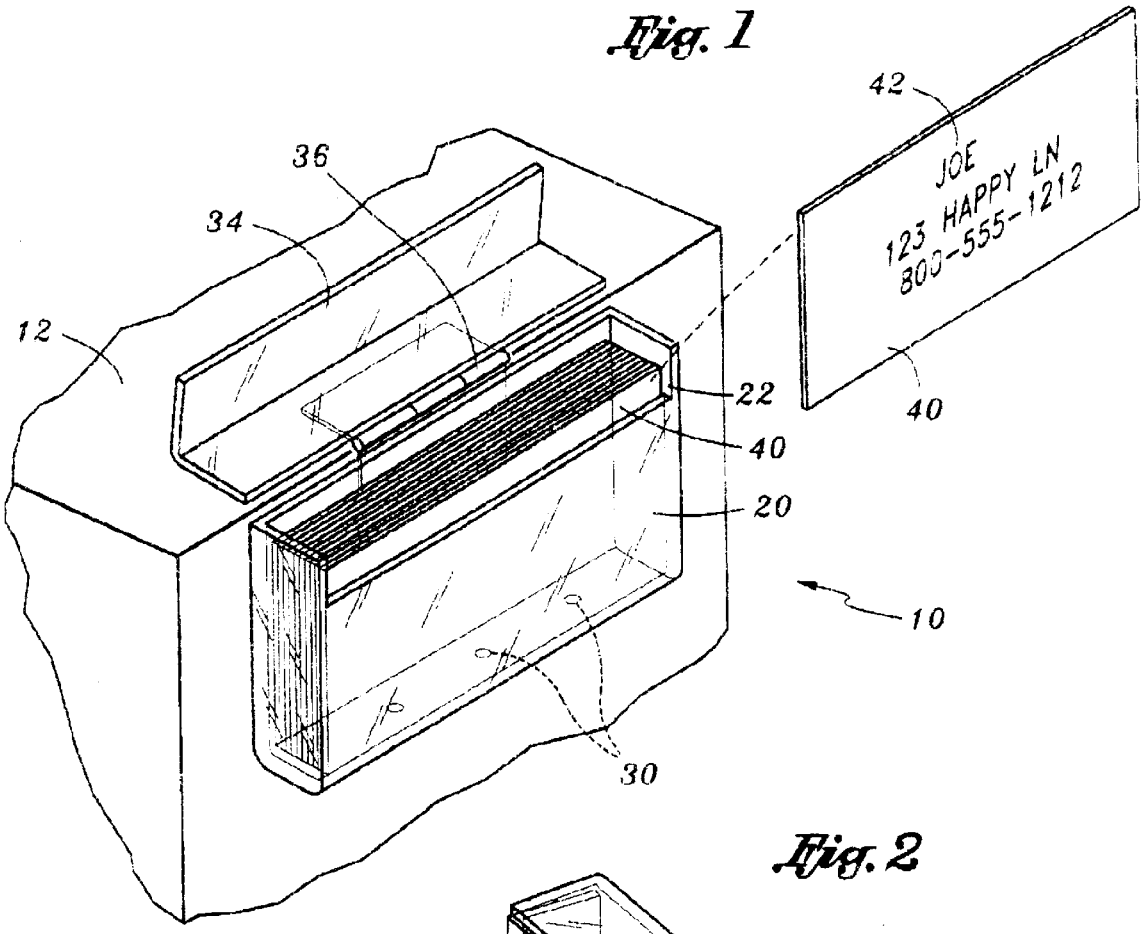
FIG. 1 is a perspective view of the preferred embodiment of the present invention.
Figure 2:
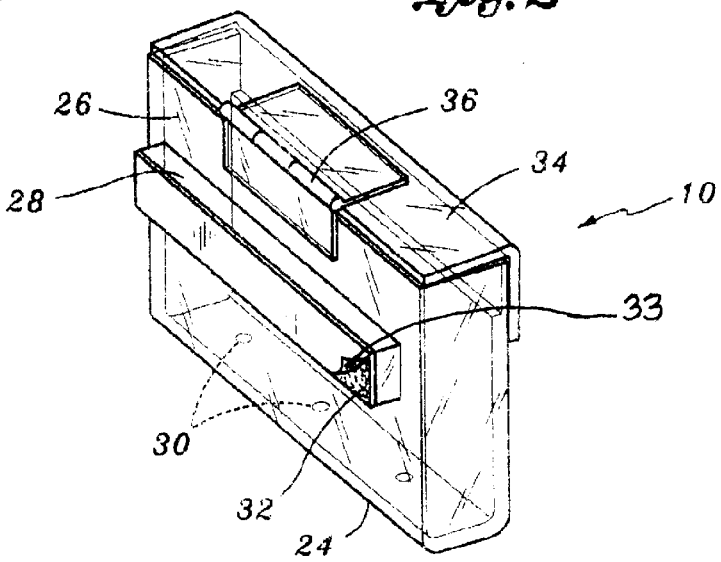
FIG. 2 is a back perspective view thereof.

As shown in FIGS. 1 and 2, in its preferred embodiment the memorial family finder 10 includes a container 20 having an opening 22 shaped to receive a message 40, preferably at least one information card. The container 20 is preferably constructed of a transparent synthetic resin such as Plexiglas™, although it is possible to construct the container 20 from almost any material capable of forming a containment device. The container 20 is preferably made of Plexiglas™ because this material is both transparent and durable. It is preferred that the container 20 be transparent so that people can see the at least one information card 40 inside the container 20 when they pass near the headstone 12. In an alternative embodiment, the container 20 is constructed of bronze or a similar high quality material to provide a more expensive alternative to the Plexiglas™ embodiment.

The container 20 preferably includes a mounting block 28 which can be attached to the headstone 12. The mounting block 28 is preferably integral with the container 20 and preferably has an adhesive 32 for attaching the container 20 to the headstone 12. The adhesive 32 is preferably covered with peel-removable paper 33 so that a the adhesive 32 is protected until the memorial family finder 10 is ready for attachment to the headstone 12.

The container 20 preferably also includes at least one weep hole 30, preferably through a bottom surface 24 of the container 20. The at least one weep hole 30 is preferred because the presence of a hole allows moisture to drain from the container 20. This is important because the at least one information card 40 may be damaged if moisture accumulates within the container 20.

The at least one information card 40 has contact information 42 printed thereon, the contact information 42 giving instructions on how to contact the user. The at least one information card 40 can be constructed with any material upon which the contact information 42 can be conveniently printed, preferably paper. While it is preferred that the at least one information card 40 be at least partially laminated to protect it from the weather, the at least one information card 40 can be a simple business card. It is preferred that the user leave more than one business card in the container 20 so that one of the distant relative may remove one of the business cards to take home and contact the user, while still leaving other business cards in the container 20 for additional distant relatives to find and use. The container 20 is preferably large enough to hold several business cards from many people at once, to facilitate the simultaneous contact of one user with many distant relatives.

A lid 34 is hingable attached to the container 20 with a hinge 36. The lid 34 pivots from a closed position for covering the opening 22, to an open position for receiving and dispensing the at least one information card 40. The lid 34 is preferably constructed of Plexiglas™ to match the container 20. The lid 34 preferably extends slightly beyond the opening 22 of the container 20 to prevent moisture from leaking into the container 20. In the preferred embodiment, the mounting block 28 is a Plexiglas™ block that extends from a rear surface 26 of the container 20 further than the hinge 36. By mounting the container 20 on a mounting block 28 that extends from the rear surface 26 further than the hinge 36, the lid 34 is allowed to open when the container 20 is mounted on the headstone 12 without being hindered by lid 34 or hinge 36 hitting the headstone 12.

The invention further includes a method for finding distant relatives using the above-described memorial family finder 10. In its broadest sense, the method requires a message 40 having contact information 42 to be left in close proximity to the headstone 12. The message 40 is preferably the at least one information card described above; however, the message 40 can be almost any item or device that can convey the contact information 42, including a printed message, a recording, a video, a magnetic storage disk, or any equivalent device. A container 20 is provided to protect the message 40 from the elements; however, the container 20 can be constructed in almost any way out of a wide variety of materials, as long as it is shaped to receive the message 40 and protect the message 40 from the elements. This container 20 is then placed in close proximity to a headstone 12 of an ancestor and the message 40 is left in the container 20 for distant relative to find and use. In one alternative embodiment, the container 20 is actually cut into the headstone 12 or built onto the headstone 12 when the headstone 12 is first constructed.

In the preferred embodiment, the user first prints his or her contact information 42 onto the at least one information card 40. The contact information 42 preferably includes information such as the user's name, address, and telephone number; however, for security reasons the information should be reasonably limited and may be limited to a special post office box address or telephone answering service. The use then attaches the container 20 to the headstone 12 of the ancestor of the user. The attachment structure described above is preferred; however, other equivalent structures can be devised by those skilled in the art. A container 20 can be attached to the headstone 12 in many ways; or the container 20 can simply be placed in close proximity to the headstone 12, as long as it does not interfere with the work of the graveyard groundskeepers. Any container 20 for holding the at least one information card 40 that is closely associated with the headstone 12 is equivalent for purposes of this method. The information card 40 is then inserted into the container 20 and the lid 34 is closed to protect the information card 40.

From this point onwards, anyone visiting the headstone 12 will have ready access to the at least one information card 40 and the contact information 42 printed thereon. Distant relatives that are far removed and otherwise untraceable will be able to contact the user at their convenience without any expensive search. Furthermore, the distant relatives can leave at least one information card 40 of their own so that when the user re-visits the headstone 12 he or she may find business cards of his or her distant relatives. Upon retrieving the at least one information card 40 bearing contact information 42 of a distant relative who has visited the headstone 12 and left the at least one information card 40, the user can contact the distant relative using the contact information 42 on the at least one information card 40. By placing memorial family finders 10 on the headstones 12 of many ancestors, the user will thereby be able to eventually establish contact with a large number of distant relatives regardless of where they live, how distant the relation, or whether the distant relative has changed their name.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method for using at least one information card to find a distant relative, the distant relative sharing a common ancestor who has a headstone, the method comprising the steps of:

a) providing a memorial family finder comprising:
at least one information card;
a container having an opening shaped to receive the at least one information card; and
a lid hingable attached to the container, the lid pivoting from a closed position for covering the opening, to an open position for receiving and dispensing the at least one information card;

b) printing a telephone number of the distant relative onto one of the at least one information card;

c) attaching the container to the headstone of the ancestor;

d) inserting the one of the at least one information card into the container; and e) closing the lid to protect the one of the at least one information card.

2. The method of claim 1 further including the steps of:

f) visiting the headstone of the ancestor;

g) retrieving the at least one of the at least one information card bearing contact information of the distant relative who has visited the headstone and left the one of the at least one information card; and h) contacting the distant relative using the contact information of the distant relative.

3. A method for using at least one information card to find a distant relative, the distant relative sharing a common ancestor who has a headstone, the method comprising the steps of:

a) providing at least one information card having a telephone number of the distant relative;

b) providing a container shaped to receive the at least one information card;

c) positioning the container in proximity to the headstone of the ancestor; and d) leaving the at least one information card in the container.

4. A method for using at least one information card to find a distant relative, the distant relative sharing a common ancestor who has a headstone, the method comprising the steps of:

a) providing a memorial family finder comprising:
at least one information card; and
a container having an opening shaped to receive the at least one information card;

b) printing a post office address of the distant relative onto one of the at least one information card;

c) attaching the container to the headstone of the ancestor; and d) inserting the one of the at least one information card into the container.

* * * * *